US006127037A

United States Patent [19]

Sargeant et al.

[11] Patent Number: 6,127,037

[45] **Date of Patent: *Oct. 3, 2000**

[54] INK JET RECORDING MEDIUM

[75] Inventors: Steven J. Sargeant, West Warwick, R.I.; Joshua D. Rundus, San Dimas, Calif.

[73] Assignee: Arkwright, Incorporated, Fiskeville, R.I.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/032,909

[22] Filed: Mar. 2, 1998

Related U.S. Application Data

[63] Continuation-in-part of application No. 08/646,400, May 9, 1996, abandoned.

[51] Int. Cl.[7] ..... B41M 5/00; B41J 2/01

[52] U.S. Cl. ..... 428/411.1; 428/195; 428/211; 428/325; 428/327; 428/328; 428/329; 428/330; 428/331; 428/522; 428/532; 347/105

[58] Field of Search ..... 428/195, 211, 428/325, 327, 328, 329, 330, 331, 500, 520, 522, 532, 537.5, 411.1

[56] References Cited

U.S. PATENT DOCUMENTS

| | | | |
|---|---|---|---|
| 4,781,978 | 11/1988 | Duan . | |
| 4,889,765 | 12/1989 | Wallace . | |
| 4,956,230 | 9/1990 | Edwards et al. . | |
| 5,389,723 | 2/1995 | Iqbal et al. . | |
| 5,605,750 | 2/1997 | Romano et al. . | |
| 5,700,582 | 12/1997 | Sargeant et al. | 428/195 |

FOREIGN PATENT DOCUMENTS

| | | |
|---|---|---|
| 0152551A1 | 8/1985 | European Pat. Off. . |
| 0484016A1 | 5/1992 | European Pat. Off. . |
| 0696516A1 | 2/1996 | European Pat. Off. . |
| 0716929A1 | 6/1996 | European Pat. Off. . |

*Primary Examiner*—Pamela R. Schwartz
*Attorney, Agent, or Firm*—Birch, Stewart, Kolasch & Birch, LLP

[57] ABSTRACT

An ink sorptive coating for ink jet recording media, and ink jet recording media that contain the same, wherein the ink jet recording medium contains a substrate having an ink sorptive layer coated thereon. The ink sorptive coating layer contains (1) a polymer or copolymer that comprises a polyalkyl oxazoline monomer unit or a polyphenyl oxazoline monomer unit, or a copolymer that comprises a polyalkyl oxazoline monomer unit and a polyphenyl oxazoline monomer unit, and (2) a hydrophilic, water-insoluble polymer or copolymer which preferably contains hydroxyl groups. The ink sorptive coating provides the ink jet media with improved image quality, dry time and a low degree of curl.

19 Claims, No Drawings

INK JET RECORDING MEDIUM

CROSS-REFERENCE TO RELATED APPLICATION

This application is a continuation-in-part of application Ser. No. 08/646,400, filed on May 9, 1996 now abandoned.

FIELD OF THE INVENTION

This invention relates to ink jet recording media, and more particularly to ink sorptive coatings that can be used in combination with a suitable substrate to provide an ink jet recording media.

BACKGROUND OF THE INVENTION

Recently, ink jet printing technology has been used for presentation, graphic arts, engineering drawing and home office applications. The performance requirements for ink jet recording media used for these applications are quite stringent. The media should provide fast drying, good color fidelity, high image resolution, and archivability. For transparency applications, curl performance on various commercial projectors is also important. There are many commercial products and proposed designs available in the field. Among them, oxazoline-based polymeric ink sorptive coatings have shown promising performance, even though only a limited amount of effort was previously expended by those skilled in the art exploring this type of chemistry for ink jet applications. As a result, only a limited amount of information on this subject is available in the prior art, or was otherwise available to the present inventors prior to their present inventive discovery.

U.S. Pat. No. 4,889,765 discloses an ink-receptive coating composition comprising a polymer of 2-oxazoline, preferably polyethyl oxazoline, and an olefin copolymer containing pendant acid groups which are substantially neutralized by a base. U.S. Pat. No. 5,389,723 discloses coatings formed from semi-interpenetrating polymeric networks comprising a blend of a polymeric matrix component, a liquid absorbent component, and a poly-functional aziridine crosslinking agent for forming water-durable networks. A polyethyl oxazoline is mentioned as a possible liquid absorbent material.

U.S. Pat. No. 4,956,230 discloses coatings containing (1) a hydrophilic polymer containing a carbonylamido group and (2) a hydrophobic polymer without acidic, hydroxyl, =NH and —$NH_2$ functional groups.

The above designs differ from the design of the recording media of the present invention, and the ink sorptive coatings used therein, in both concept and compositions. For example, the present inventive design does not require acidic functional groups containing polyolefin copolymers and aziridine crosslinking agents. Instead, in the present invention, hydrogels are formed through inherent physical and chemical interactions. Furthermore, we have found that the present inventive design provides optimal performance by using hydrophilic polymers containing acidic, hydroxyl, =NH and —$NH_2$ functional groups, especially hydroxyl groups, in the polyalkyl- or polyphenyl-oxazoline based ink sorptive coatings of the present invention. That is, we have discovered that such functional groups can be helpful in designing ink jet media containing hydrophilic alkyl and phenyl oxazoline-based polymeric ink sorptive coatings.

SUMMARY OF THE INVENTION

We have designed an ink sorptive coating that can be used for ink jet recording media (e.g., ink jet recording paper, ink jet recording film and other substrate-based ink jet recording products). The ink sorptive coating can be used to provide ink jet recording media having improved performance for ink jet recording applications.

Accordingly, an object of the present invention is to provide an ink sorptive coating that can be used for ink jet recording media. Another object of the present invention is to provide ink jet recording media, wherein an ink sorptive coating is applied to the surface of a suitable substrate, and wherein the coating provides improved image quality, curl performance and dry time to the prepared media.

The good performance properties of the ink sorptive coatings and recording media of the present invention are believed to result from the fact that the ink sorptive coatings of the present invention, comprise:

(1) a polyalkyl oxazoline polymer, a polyphenyl oxazoline polymer, a copolymer containing a polyalkyl oxazoline monomer unit, a copolymer containing a polyphenyl oxazoline monomer unit, or a copolymer containing a polyalkyl oxazoline monomer unit and a polyphenyl oxazoline monomer unit; and (2) a hydrophilic polymer or copolymer containing acidic, hydroxyl =NH and —$NH_2$ functional groups. In a preferred embodiment, the second component is a hydroxyl (—OH) group-containing hydrophilic polymer or copolymer.

Optionally, a surface coating layer containing a cellulose ether may be employed over the ink sorptive coatings of the inventive media in order to achieve desired performance properties.

DETAILED DESCRIPTION OF THE INVENTION

The following detailed description is provided as an aid to those desiring to practice the present invention. However, it is not to be construed as being unduly limiting to the present inventive discovery, since those of ordinary skill in the art will readily recognize that the various inventive embodiments disclosed herein may be modified using standard techniques and materials known in the art, without departing from the spirit or scope of the present invention.

The ink jet recording medium of the present invention contains a substrate having on a surface thereof at least one ink sorptive coating layer that comprises:

(1) a polyalkyl oxazoline polymer, a polyphenyl oxazoline polymer, a copolymer containing a polyalkyl oxazoline monomer unit, a copolymer containing a polyphenyl oxazoline monomer unit, or a copolymer containing a polyalkyl oxazoline monomer unit and a polyphenyl oxazoline monomer unit; and (2) a hydrophilic, water-insoluble polymer or copolymer containing acidic, hydroxyl, =NH and/or —$NH_2$ functional groups, preferably a hydroxyl group (—OH) containing hydrophilic polymer or copolymer. Typical examples of polyalkyl oxazoline and polyphenyl oxazoline monomer units that are useful in preparing the ink sorptive coatings and ink jet recording media of the present invention are polymethyl oxazoline, polyethyl oxazoline polypropyl oxazoline, polyphenyl oxazoline, and the like. Homopolymers and copolymers containing such monomer units are useful in preparing the ink sorptive coatings and ink jet recording media of the present invention. Preferably, the weight average molecular weight of such polymers and copolymers should be greater than about 40,000 and more preferably greater than about 200,000.

Typical examples of the hydroxyl group (—OH) containing hydrophilic polymers and copolymers that are useful in preparing the ink sorptive coatings and ink jet recording media of the present invention are those that contain an ethylcellulose monomer unit, a partially hydrolyzed poly (vinyl acetate) monomer unit, a nitrocellulose monomer unit, a hydroxyethyl methacrylate monomer unit, and the like. These polymers and copolymers must be hydrophilic; for example, the degree of hydrolysis will determine whether a polymer is hydrophilic or not. The term "hydrophilic" herein is intended to refer to substances that have a strong affinity for binding or absorbing water, which results in swelling and formation of reversible gels; see *The Condensed Chemical Dictionary,* 8th Edition, revised by Gessner G. Hawley (Van Nostrand Reinhold Company). Preferably, the weight average molecular weight of such polymers and copolymers should be greater than about 25,000 and more preferably greater than about 100,000.

The ink sorptive coating(s) of the present invention preferably contains about 50% to about 98% of the polyalkyl oxazoline and/or polyphenyl oxazoline containing polymer (s) or copolymer(s) therein, on a weight/weight basis; more preferably about 80% to about 95%, on a weight/weight basis.

For some applications, a surface coating over said ink sorptive coating layer(s) is required. In such an instance, the ink sorptive coating(s) is coated directly on the base substrate and then dried. The surface coating layer is then applied on top of the ink sorptive coating layer(s), with the surface coating layer containing at least one cellulose ether.

Typical examples of cellulose ethers that may be used in the surface coatings of the present invention are methyl cellulose, hydroxyethyl cellulose, hydroxypropyl cellulose, hydroxypropyl ethyl cellulose, hydroxypropyl methyl cellulose, hydroxyethyl methyl cellulose and carboxymethyl cellulose.

The ink sorptive coatings of the present invention should have a glass transition temperature, Tg, that is greater than about 40° C., and preferably that is greater than about 60° C. (When the Tg is not attainable, the softening temperature is used.) When the Tg is below about 40° C., the coatings are too tacky for commercial applications.

Glass transition temperature is measured on a Differential Scanning Calorimeter (TA Instruments, Model DC 2910), calibrated with appropriate standards. The reading and baseline errors from running replicate DSC experiments leads to a typical accuracy in measuring the Tg of about 3° C. Measurements of heat flow versus temperature are made upon heating in the range of about 5° to 200° C. at a heating rate of 20° C./minute. The sample chamber is purged with nitrogen. Film-like samples are encapsulated in an aluminum pan. The midpoint method is used to obtain the glass transition temperature of the polymer blend from the measured DSC curve of heat flow versus temperature.

The thickness of the inventive ink sorptive coatings of the present invention is not particularly restricted, but is generally governed by application of each ink sorptive coating layer to the substrate in an amount of from about 2 grams per square meter to about 30 grams per square meter.

The ink sorptive coatings disclosed in this invention can be applied to various base substrates in order to provide one of the present inventive ink jet recording media. For example, suitable substrates for such purposes include transparent plastics, translucent plastics, matte plastics, opaque plastics, papers and the like. Suitable polymeric materials for use as the base substrate include polyester, cellulose esters, polystyrene, polypropylene, poly(vinyl acetate), polycarbonate, and the like. Poly(ethylene terephthalate) film is a particularly preferred base substrate. Further, while almost any paper can be used as the base substrate, clay coated papers and polyolefin coated papers are particularly preferred as base substrate papers. The thickness of the base substrate is not particularly restricted but should generally be in the range of from about 1 to about 10 mils, preferably from about 3.0 to about 5.0 mils. The base substrate may be pretreated to enhance adhesion of the ink sorptive coating thereto, if so desired.

According to a preferred embodiment of the invention, the ink sorptive coatings of the present invention may further comprise about 0.1 to about 15% by weight of a particulate(s) based on the weight of the dry coating. Suitable particulates that can be used in the ink sorptive coating (s) to modify their surface properties include inorganic particulates such as silica, alumina, kaolin, glass beads, calcium carbonate and titanium oxide, and organic particulates such as polyolefins, polystyrene, polyurethane, starch, poly(methyl methacrylate) and polytetrafluoroethylene. Such particulates may also be included in the optional surface coating layers that may be used in the inventive media, if so desired. In such an instance, the particulate(s) may be present in the optional surface coating layers in an amount of about 0.1 to about 15% by weight, based on the weight of the dry coatings.

In practice, various additives may also be employed in the ink sorptive coatings of the present invention, as well as in the optional surface coatings. These additives can include surface active agents which control the wetting or spreading action of coating solutions, antistatic agents, suspending agents, and acidic compounds to control the pH of the coatings. Other additives may also be used, if so desired.

The surface of the base substrate which does not bear the ink sorptive coating may have a backing material placed thereon in order to reduce electrostatic charge and to reduce sheet-to-sheet friction and sticking, if so desired. The backing material may either be a polymeric coating, a polymer film or a paper backing material.

Any of a number of coating methods may be employed to coat the ink sorptive coating(s) onto a suitable substrate. For example, roller coating, blade coating, wire-bar coating, dip coating, extrusion coating, air knife coating, curtain coating, slide coating, doctor coating or gravure coating, may be used and are well known in the art. Such coating methods may also be used to coat the optional surface coating layers on the inventive ink jet recording media, if so desired.

The following Examples are given merely as illustrative of the invention and are not to be considered as limiting. In the following examples, parts are given as parts by weight, based on solid content.

EXAMPLE I

A coating composition is prepared according to the following formulation:

| Ink Sorptive Coating: | |
|---|---|
| Poly (2-ethyl-2-oxazoline)[1] | 85 parts |
| Copolymer A[2] | 15 parts |
| Methyl ethyl ketone | 280 parts |
| Propylene glycol monomethyl ether | 120 parts |
| Poly(methyl methacrylate) beads | 1 part |

[1]Manufactured by PCI, Inc.

[2]A hydrophilic and water-insoluble random copolymer of methyl methacrylate and hydroxyethyl methacrylate manufactured by Allied Colloids.

The coating is applied to a polyester film (ICI Films) using a No. 42 Meyer rod. The ink sorptive coating is dried at about 130° C. for about 4 minutes.

EXAMPLE II

A coating composition is prepared according to the following formulation:

| Ink Sorptive Coating: | |
|---|---|
| Poly (2-ethyl-2-oxazoline) | 75 parts |
| Copolymer B[1] | 15 parts |
| Isopropyl alcohol | 250 parts |
| Poly(methyl methacrylate) beads[2] | 1 part |

[1]A hydrophilic and water-insoluble graft copolymer of methyl methacrylate and hydroxyethyl methacrylate manufactured by Soken, Inc.
[2]Manufactured by Soken Chemical & Engineering Company, Ltd.

The coating is applied to a polyester film (ICI Films) using a No. 42 Meyer rod. The ink sorptive coating is dried at about 130° C. for about 4 minutes.

EXAMPLE III

A coating composition is prepared according to the following formulation:

| Ink Sorptive Coating: | |
|---|---|
| Poly (2-ethyl-2-oxazoline)-co-(2-phenyl-2-oxazoline)[1] | 85 parts |
| Copolymer A | 15 parts |
| Methyl ethyl ketone | 280 parts |
| Propylene glycol monomethyl ether | 120 parts |
| Poly(methyl methacrylate) beads | 1 part |

[1]Manufactured by PCI, Inc.

The coating is applied to a polyester film (ICI Films) using a No. 42 Meyer rod. The ink sorptive coating is dried at about 130° C. for about 4 minutes. A surface coating layer is then coated over the ink sorptive coating according to the following formulation:

| Surface Coating Layer | |
|---|---|
| Hydroxypropyl methyl cellulose[1] | 1 part |
| Water | 99 parts |

[1]Manufactured by Dow Chemical Company.

The surface coating layer is applied with a No. 8 Meyer rod and is dried at about 130° C. for about 2 minutes.

EXAMPLE IV

The ink sorptive coating of Example I is applied to a polyester film (ICI Films) using a No. 42 Meyer rod and dried for about 4 minutes at about 130° C. The surface coating layer of Example III is then coated over the ink sorptive coating. The surface coating layer is applied with a No. 8 Meyer rod and is dried at about 130° C. for about 2 minutes.

EXAMPLE V

A coating composition is prepared according to the following formulation:

| Ink Sorptive Coating | |
|---|---|
| Poly (2-ethyl-2-oxazoline) | 75 parts |
| Copolymer C[1] | 30 parts |
| Isopropyl alcohol | 250 parts |
| Poly (methyl methacrylate) beads | 1 part |

[1]A hydrophilic and water-insoluble random copolymer of methyl methacrylate and dimethylamino methyl methacrylate manufactured by Allied Colloids, Inc.

The coating is applied to a polyester film (ICI Films) using a No. 42 Meyer rod. The ink sorptive coating is dried at about 130° C. for about 4 minutes.

EXAMPLE VI

The ink sorptive coating of Example V is applied to a polyester film (ICI Films) using a No. 42 Meyer rod and dried for about 4 minutes at about 130° C. A surface coating layer having the following formulation is then coated over the ink sorptive coating:

| Surface Coating Layer | |
|---|---|
| Hydropropyl methyl celluose[1] | 1 part |
| Water | 99 parts |

[1]Manufactured by Dow Chemical Company.

The surface coating layer is applied with a No. 8 Meyer rod and is dried at about 130° C. for about 2 minutes.

COMPARATIVE EXAMPLE I

A coating composition is prepared according to the following formulation:

| Ink Sorptive Coating: | |
|---|---|
| Poly (2-ethyl-2-oxazoline) | 85 parts |
| Polyurethane[1] | 15 parts |
| Methyl ethyl ketone | 280 parts |
| Propylene glycol monomethyl ether | 120 parts |
| Poly(methyl methacrylate) beads | 1 part |

[1]Manufactured by B.F. Goodrich, Inc.

The coating is applied to a polyester film (ICI Films) using a No. 42 Meyer rod. The ink sorptive coating is dried at 130° C. for about 4 minutes.

COMPARATIVE EXAMPLE II

A coating composition is prepared according to the following formulation:

| Ink Sorptive Coating: | |
|---|---|
| PVP K-90[1] | 85 parts |
| Copolymer A | 15 parts |
| Methyl ethyl ketone | 280 parts |

-continued

| Ink Sorptive Coating: | |
|---|---|
| Propylene monomethyl ether | 129 parts |
| Poly(methyl methacrylate) beads | 1 part |

(1)Poly (vinylpyrrolidone), manufactured by ISP Corporation.

The coating is applied to a polyester film (ICI Films) using a No. 42 Meyer rod. The ink sorptive coating is dried at 130° C. for about 4 minutes.

The prepared ink jet recording media are evaluated for performance on a HEWLETT PACKARD DESKJET 850C printer with the ink jet pens supplied by HEWLETT PACKARD for the DESKJET 850C printer.

The dry time of each example is measured by initially printing a test plot onto each ink jet recording medium example. The printed sheet is then placed on top of a 20 lb. ream of XEROX 4200 paper. This is taken as time zero ($t_0$). At one minute intervals a sheet of white bond paper is placed onto the surface of the print. Another 20 lb. ream of XEROX 4200 paper is placed on top of the white bond paper. After five seconds the top ream of paper and white bond paper is removed from the top of the print. The print is dry when no transfer of ink between the example and the white bond paper has occurred, which is termed the dry time ($t_{dry}$).

The projector curl performance is conducted on a POLAROID overhead projector. The projector platen surface is allowed to warm up to 40° C. The ink jet recording medium is placed onto the platen surface for one minute. After one minute the distance that each of the corners of the ink jet recording medium has raised from the platen surface is measured. The highest measured distance is the projector curl of the ink jet recording medium. It is the inventors' experience that the ink jet recording media will give defocused images or low image resolution when the projector curl is greater than about 10 mm.

The black image optical density or KOD is measured on a MACBETH TD904 (Macbeth Process Measurements). A reading is taken at four different locations along a solid black image strip. The average of the four readings is the black image optical density.

The glass transition temperature, dry time, projector curl and black image optical density of each example and comparative example are provided in Table I, below.

TABLE I

The Performance Comparison of Ink Jet Recording Media

| Example | Glass Transition Temperature (Tg, ° C.) | Dry Time (minutes) | Projector Curl (mm) | Black Image Optical Density (KOD) |
|---|---|---|---|---|
| I | 57 | 2.5 | 2 | 0.88 |
| II | 52 | 2.5 | 3 | 0.77 |
| III | 57 | 3 | 4 | 1.39 |
| IV | 60 | >4 | 5 | 1.03 |
| V | 57 | 2 | 3 | 0.47 |
| VI | 52 | 2 | 5 | 1.85 |
| CI | 50 | >4 | 0 | .42 |
| CII | 156 | >4 | 54 | 1.43 |

As shown in Table I, each of the inventive Examples I–VI exhibited an improved combination of properties when compared with the Comparative Examples C-I and C-II. This is evident from their performances in curl, dry time and optical density.

For example, the inventive media of Examples I–VI possess good black image optical densities. This is important, since good performance in this test is an indicator of a low amount of pigment ink cracking. Specifically, the lower the optical density, the higher the degree of cracking.

Notably, the ink jet recording media of the present invention possess an improved optical density without experiencing a deterioration in other properties such as curl. In this regard, Table I clearly shows that the ink jet recording media of the present invention possess good projector curl performance properties (i.e, much less than 10 mm of curl).

Additionally, the ink jet recording media of the present invention have the advantage of an improved dry time, which can allow for a higher throughput in ink jet printing devices.

Each of the patents referred to herein is incorporated by reference herein in its entirety.

What is claimed is:

1. An ink jet recording medium, comprising a substrate having coated on a surface of said substrate an ink sorptive coating layer that contains:

a polymer or copolymer that comprises a polyalkyl oxazoline monomer unit or a polyphenyl oxazoline monomer unit, or a copolymer that comprises a polyalkyl oxazoline monomer unit and a polyphenyl oxazoline monomer unit; and a hydrophilic, water-insoluble polymer or copolymer containing acidic, hydroxyl, =NH and/or —$NH_2$ functional groups.

2. The ink jet recording medium according to claim 1, wherein said hydrophilic polymer or copolymer contains hydroxyl groups.

3. The ink jet recording medium according to claim 1 or claim 2, wherein said polyalkyl oxazoline monomer unit is selected from the group consisting of a polymethyl oxazoline monomer unit, a polyethyl oxazoline monomer unit, and a polypropyl oxazoline monomer unit.

4. The ink jet recording medium according to claim 1 or claim 2, wherein said polymer or copolymer that comprises said polyalkyl oxazoline monomer unit or said polyphenyl oxazoline monomer unit has a weight average molecular weight that is greater than about 40,000.

5. The ink jet recording medium according to claim 1 or claim 2, wherein said hydrophilic polymer or copolymer comprises monomer units of:

ethylcellulose, partially hydrolyzed poly(vinyl acetate), nitrocellulose, or hydroxyethyl methacrylate.

6. The ink jet recording medium according to claim 2, wherein the hydroxyl group-containing polymer or copolymer has a weight average molecular weight that is greater than about 25,000.

7. The ink jet recording medium according to claim 1 or claim 2, wherein said ink sorptive coating has a glass transition temperature or softening temperature of at least about 40° C.

8. The ink jet recording medium according to claim 1 or claim 2, wherein said medium further comprises a surface coating layer that is overcoated on said ink sorptive coating layer.

9. The ink jet recording medium according to claim 8, wherein said surface coating layer contains a cellulose ether.

10. The ink jet recording medium according to claim 9, wherein said cellulose ether is selected from the group consisting of:

methyl cellulose, hydroxyethyl cellulose, hydroxypropyl cellulose, hydroxypropyl ethyl cellulose, hydroxypropyl methyl cellulose, hydroxyethyl methyl cellulose and carboxymethyl cellulose.

11. The ink jet recording medium according to claim 9, wherein said surface layer contains a particulate that is selected from the group consisting of:

silica, alumina, kaolin, glass beads, calcium carbonate, titanium oxide, polyolefins, polystyrene, polyurethane, starch, poly(methyl methacrylate) and polytetrafluoroethylene.

12. The ink jet recording medium according to claim 1 or claim 2, wherein said ink sorptive coating contains a particulate that is selected from the group consisting of:

silica, alumina, kaolin, glass beads, calcium carbonate, titanium oxide, polyolefins, polystyrene, polyurethane, starch, poly(methyl methacrylate) and polytetrafluoroethylene.

13. The ink jet recording medium according to claim 1 or claim 2, wherein said substrate is a transparent plastic substrate.

14. The ink jet recording medium according to claim 1 or claim 2, wherein said substrate is an opaque plastic substrate.

15. The ink jet recording medium according to claim 1 or claim 2, wherein said substrate is a paper.

16. The ink jet recording medium according to claim 1 or claim 2, wherein said substrate is a matte plastic substrate.

17. The ink jet recording medium according to claim 1 or claim 2, wherein said substrate is a translucent substrate.

18. The ink jet recording medium according to claim 1 or claim 2, wherein said substrate is a textile material.

19. A process of ink jet printing which comprises: applying a liquid ink to the ink sorptive coating layer of the ink jet recording medium of claim 1 or claim 2.

* * * * *